US006736483B1

(12) United States Patent
Hu

(10) Patent No.: US 6,736,483 B1
(45) Date of Patent: May 18, 2004

(54) TWO-DIMENSIONAL AUTO COMPENSATED MULTI-AXIS TOLERANCE ADAPTIVE SYSTEM

(75) Inventor: Wen Hu Hu, Sanchung (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/336,673

(22) Filed: Jan. 6, 2003

(51) Int. Cl.[7] ..... B41J 23/00; B41J 29/393
(52) U.S. Cl. ..... 347/37; 347/19
(58) Field of Search ..... 347/19, 37, 8, 347/44

(56) References Cited

U.S. PATENT DOCUMENTS 5,468,076 A * 11/1995 Hirano et al. ..... 400/59
6,059,392 A * 5/2000 Park ..... 347/8
6,375,297 B1 * 4/2002 Hayashi et al. ..... 347/14
6,485,124 B1 * 11/2002 King et al. ..... 347/19

* cited by examiner

*Primary Examiner*—Stephen D. Meier
*Assistant Examiner*—Alfred Dudding
(74) *Attorney, Agent, or Firm*—Birch, Stewart, Kolasch & Birch, LLP

(57) ABSTRACT

A two-dimensional auto compensated multi-axis tolerance adaptive system used in the cartridge carrier of an inject office machine is constructed to include a carrier unit, a reciprocation mechanism, and a driving mechanism, the carrier unit having a clearance sensor and a bias sensor, the driving mechanism including a rotating unit fastened pivotally with the carrier unit and a lifting unit coupled to the reciprocation mechanism for a linear movement for enabling the plane of rotation of the rotating unit to form with the straight lifting line of the lifting unit a X-Y plane and Z-axis space coordinates system. By means of the detection and scanning of the clearance sensor and the bias sensor, the ink cartridge carrier actively controls the optimum printing clearance between the ink jet nozzle and the media.

10 Claims, 9 Drawing Sheets

TWO-DIMENSIONAL AUTO COMPENSATED MULTI-AXIS TOLERANCE ADAPTIVE SYSTEM

BACKGROUND OF THE INVENTION

1. Field of the Invention

The present invention relates to a dual-axis or multi-axis motion implement and, more specifically, to a two-dimensional auto compensated multi-axis tolerance adaptive system for adjusting clearance between nozzle and media, and automatically positioning of the ink jet cartridge of an ink jet office machine such as ink jet printer, ink jet plotter, or the like.

2. Description of the Related Art

In variety of implements, the principle of axial movement is employed to adjust the operation position, so as to achieve material treatment. A printer is one of the important data output implements of a computer system that employs the principle of axial movement to adjust the operation position. Nowadays, an ink jet printer has become one of the standard equipment of a computer system for the advantages of abundant color variation and reasonable cost. When designing an ink jet printer, the ink jet quality control is the most important factor to be taken into account. A good printing quality shows the reality of the data, and depends on the quality of the ink used and the control of the optimum printing environment between the ink cartridge carrier and the media.

FIG. 1 shows the ink cartridge carrier of an ink jet printer according to the prior art. As illustrated, the ink cartridge carrier comprises a carrier unit 7 and a reciprocation mechanism 8. The carrier unit 7 is fixedly fastened to the reciprocation mechanism 8. The reciprocation mechanism 8 comprises a bearing block 80, and an axle bearing 82 fixedly fastened to the bearing block 80 by screws 81 and coupled to an axle for enabling the reciprocation mechanism 8 to be moved along the axle so as to achieve the ink jet nozzle 70 reciprocating printing job. Further, a media feed tray and a media feed roller assembly are provided below the ink cartridge carrier for feeding media for printing. According to this design, the clearance between the ink jet nozzle and the media is mechanically controlled by means of the adjustment of an adjustment rod in the housing of the ink jet printer relative to the axle of the ink cartridge carrier. Due to the limitation of the space arrangement of the housing of the ink jet printer and the related component parts, the adjustment rod can only adjust the ink cartridge carrier between limited positions, that do not fit the thickness of a variety of media. If the clearance between the ink jet nozzle and the media is excessively high, the jetted ink may disperse. If the clearance between the ink jet nozzle and the media is excessively low, the problem of ink dragging may occur, resulting in a poor printing quality and contamination of the media.

Further, the component parts of an ink jet printer have a manufacturing error due to the error of molds. When the component parts of an ink jet printer assembled, an assembly error exists. For example, the axle of the ink cartridge carrier and the axles of the media feed roller assembly may not perfectly be set in parallel, the axles may be biased due to an error of the related axle bearings or axle holes. The biasing of the axles and the dimensional error between the ink cartridge and the ink cartridge carrier as well as the error of angle between the ink jet nozzle and the ink cartridge result in line trace discontinuous and biasing Therefore, it is desirable to provide an ink cartridge carrier control system that eliminates the aforesaid drawbacks.

SUMMARY OF THE INVENTION

The present invention has been accomplished under the circumstances in view. It is the main object of the present invention to provide a two-dimensional auto compensated multi-axis tolerance adaptive system, which enables the ink jet printer to maintain the optimum printing distance when printing different thickness of media, preventing dragging of ink and improving the printing quality. It is another object of the present invention to provide a two-dimensional auto compensated multi-axis tolerance adaptive system, which compensates and absorbs the error of component parts of the ink jet printer, the manufacturing error and the assembly error, eliminating line trace discontinuous and biasing. According to the invention, the two-dimensional auto compensated multi-axis tolerance adaptive system is used in a multi-axis motion implement to drive the multi-axis motion implement and to record the driving action in an object, the two-dimensional auto compensated multi-axis tolerance adaptive system comprising: a carrier unit, the carrier unit comprising a clearance sensor and a bias sensor; a reciprocation mechanism installed in the multi-axis motion implement to make a reciprocating motion; and a driving mechanism, the driving mechanism comprising a rotating unit fastened pivotally with the carrier unit, and a lifting unit coupled to the reciprocation mechanism for a linear movement for enabling the plane of rotation of the rotating unit to form a X-Y plane and Z-axis space coordinates system with the straight lifting line of the lifting unit. The clearance sensor of the carrier unit measures the distance between the carrier unit and the object, compares the measured data with a built-in comparison table, and drives the lifting unit to move the carrier unit in Z-axis direction according to the comparison result. The bias sensor of the carrier unit scans an initial calibration pattern of the object, compares the scanned data with a built-in comparison table, and drives the rotating unit to move the carrier unit on X-Y plane in Z-axis direction according to the comparison result.

DETAILED DESCRIPTION OF THE PREFERRED EMBODIMENT

Figure 1:
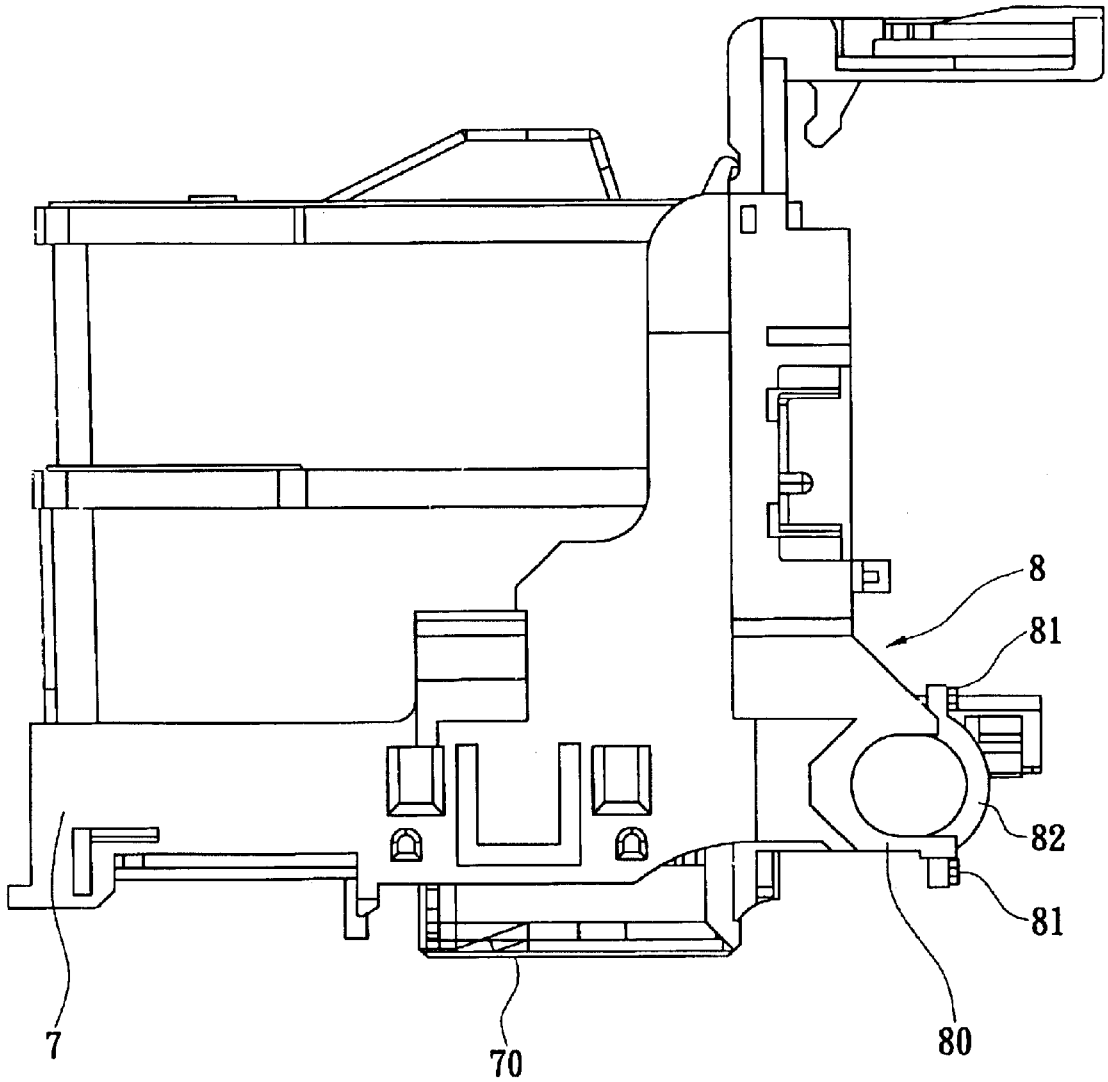
FIG. 1 PRIOR ART
FIG. 1 is a schematic plain view of an ink cartridge carrier for ink jet printer according to the prior art.
Figure 2:
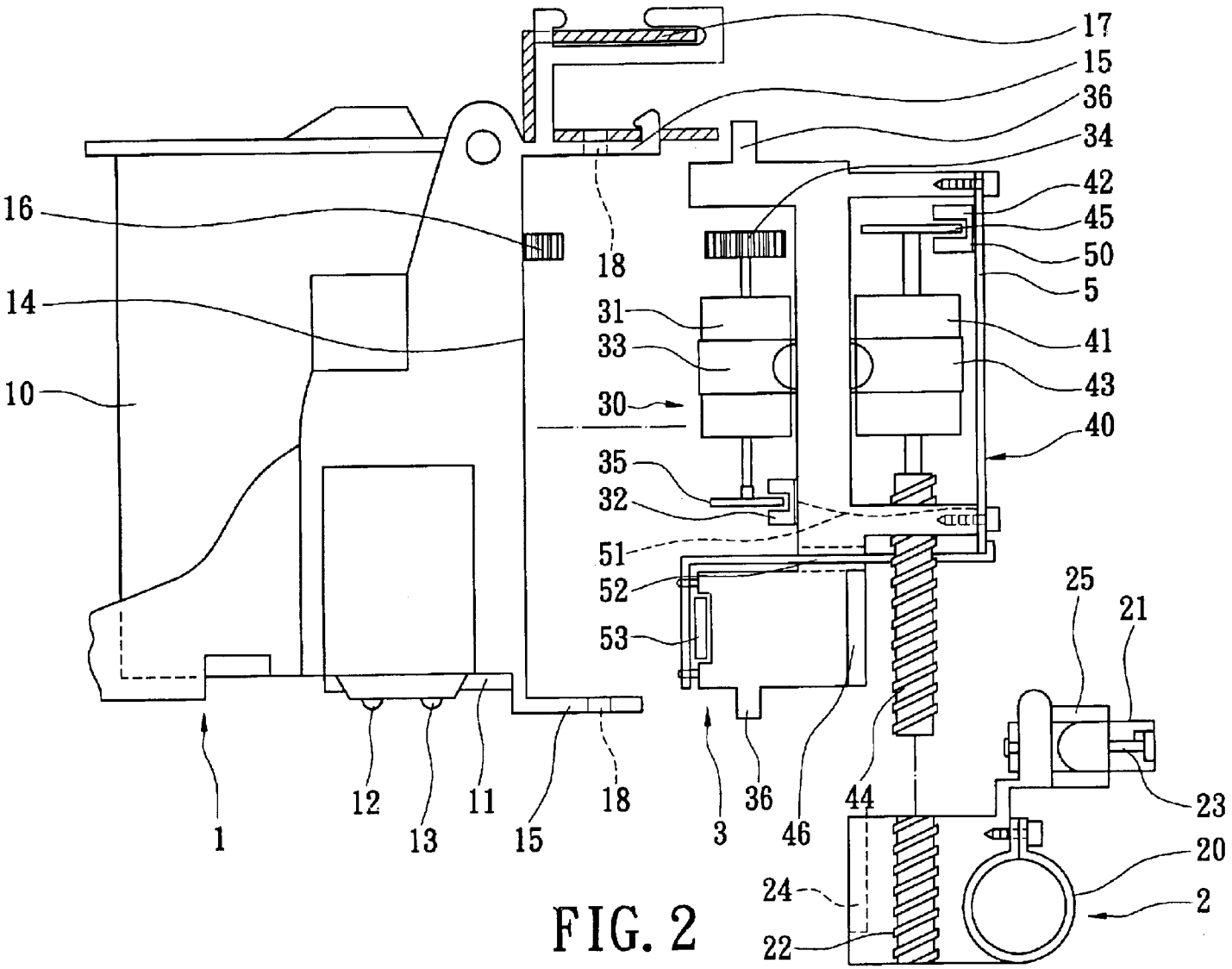
FIG. 2 is an exploded plain view of the present invention.
Figure 3:
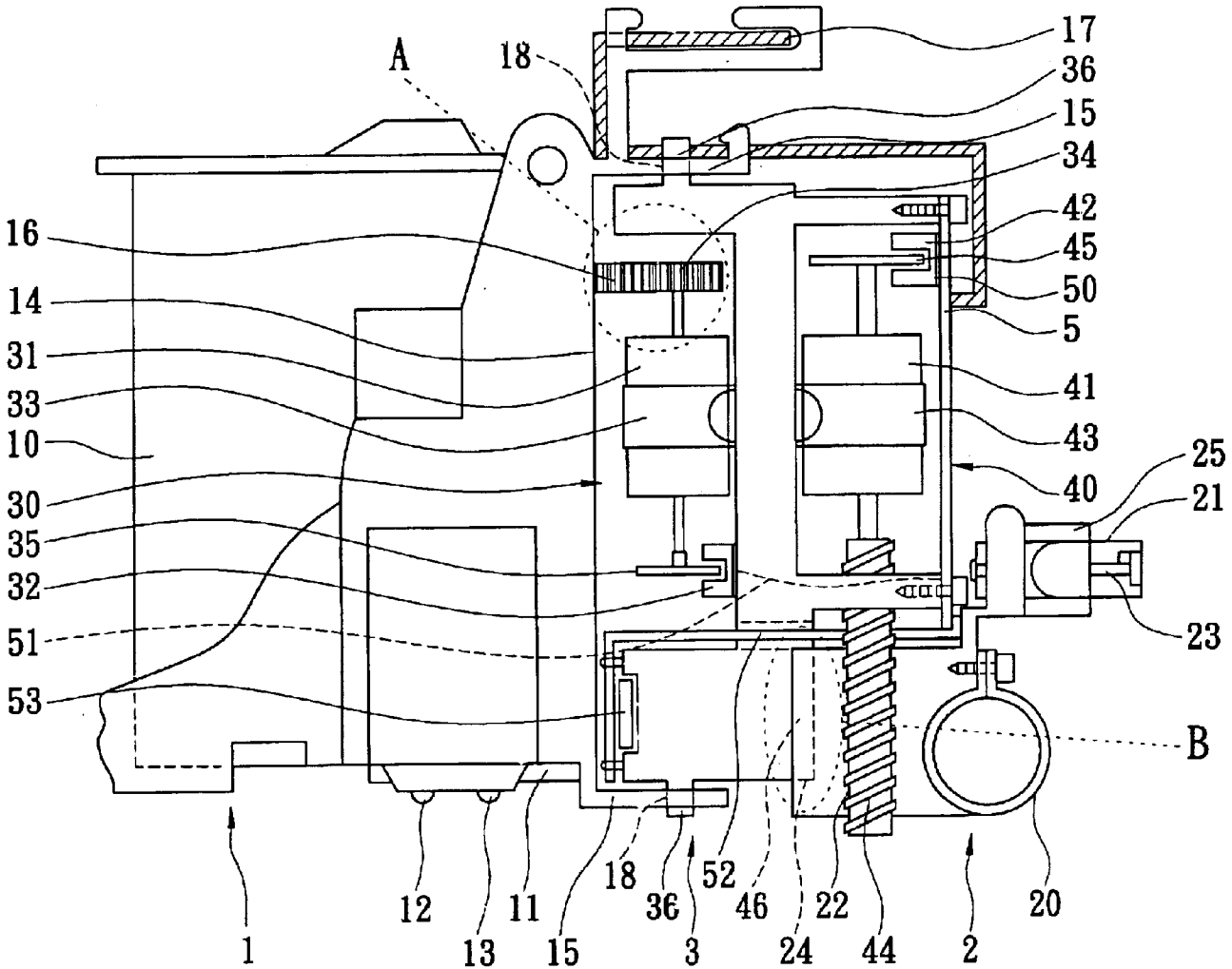
FIG. 3 is an assembly plain view of the present invention.

Referring to FIGS. 2 and 3, the two-dimensional auto compensated multi-axis tolerance adaptive system of the present invention is used in a multi-axis motion implement, for example, the ink cartridge carrier of a ink jet printer to control the motion of the ink cartridge carrier and to record the driving action in an object (In this embodiment, the object could be a sheet of media). The ink cartridge carrier comprises a carrier unit 1, a reciprocation mechanism 2, and a driving mechanism 3.

The carrier unit 1 is adapted to carry an ink cartridge 10, comprising an ink jet nozzle 11, which may be formed integral with the ink cartridge. 10 or the carrier unit 1, a clearance sensor 12 and a bias sensor 13 around the border area of the ink jet nozzle 11, a rear side wall 14, two lugs 15 protruded from top and bottom sides of the rear side wall 14 and defining a respective pivot hole 18, a serrated portion 16 formed in the rear side wall 14, a signal line 17 electrically connected to the circuit board of the ink jet printer (not shown) for transmission of printing commands.

The reciprocation mechanism 2 is installed in the multi-axis motion implement (ink jet printer) for reciprocating motion, comprised of an axle bearing 20, a belt carrier 21, a guide screw hole 22, and a plurality of dovetail grooves 24 arranged in parallel to the guide screw hole 22. The axle bearing 20 is coupled to one axle of the ink jet printer (not shown), for enabling the ink cartridge carrier to be reciprocated along the axle so that the ink jet nozzle 11 can execute the reciprocating printing job. The belt carrier 21 is covered with vibration absorbing rubber 25, and used to hold the belt 23 of the ink jet printer so that the motor of the ink jet printer can drive the belt 23 to reciprocate the ink cartridge carrier along the axle.

Figure 3A:
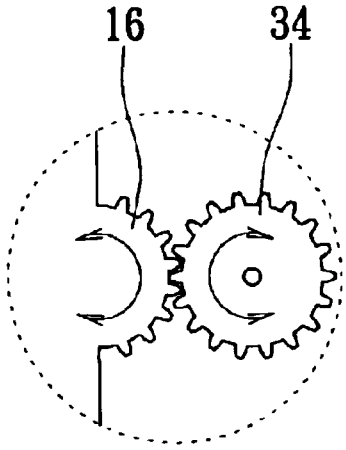
FIG. 3A is an enlarged view of part A of FIG. 3.
Figure 3B:
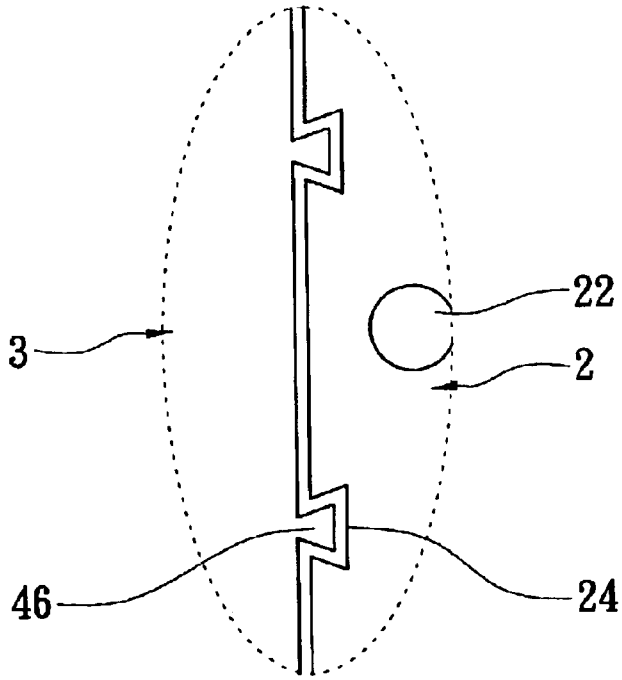
FIG. 3B is an enlarged view of part B of FIG. 3.

The driving mechanism 3 comprises a rotating unit 30 and a lifting unit 40. The rotating unit 30 comprises a rotary driver 31 and an encoder 32. The rotary driver 31 can be a motor held in position by a C-shaped clamp 33, having a pinion 34 and an encoder wheel 35 at two distal ends of the output shaft thereof. The pinion 34 is meshed with the serrated portion 16 of the carrier unit 1 (see FIG. 3A). The encoder wheel 35 is peripherally received in the encoder 32 of the rotating unit 30. The rotating unit 30 further comprises two pivot pins 36 axially aligned with the rotary driver 31 and respectively pivoted to the pivot holes 18 of the lugs 15 of the carrier unit 1. The lifting unit 40 comprises a lifting driver 41 and an encoder 42. The lifting driver 41 can be a motor held in position by a C-shaped clamp 43, having a guide screw 44 and an encoder wheel 45 at two distal ends of the output shaft thereof. The guide screw 44 is threaded into the guide screw hole 22 of the reciprocation mechanism 2. The encoder wheel 45 is peripherally received in the encoder 42 of the lifting unit 40. The lifting unit 40 further comprises dovetail rails 46 respectively coupled to the dovetail grooves 24 of the reciprocation mechanism 2 (see FIG. 3B), for enabling the lifting unit 40 to be coupled to the reciprocation mechanism 2 and moved relative to the reciprocation mechanism 2. The driving mechanism 3 has a circuit board 5 fixedly secured thereto. The circuit board 5 has signal lines 50 and 51 respectively connected to the encoders 42 and 32 to provide clearance control and angle control feedback signals. The circuit board 5 is also connected to the signal line 17 to transmit commands to the lifting driver 41 and the rotary driver 31. The circuit board 5 further comprises a flexible printed circuit board 52 supported on a soft cushion pad 53 for the connection of the circuits (not shown) of the carrier unit 1 for transmitting printing commands.

Figure 4:
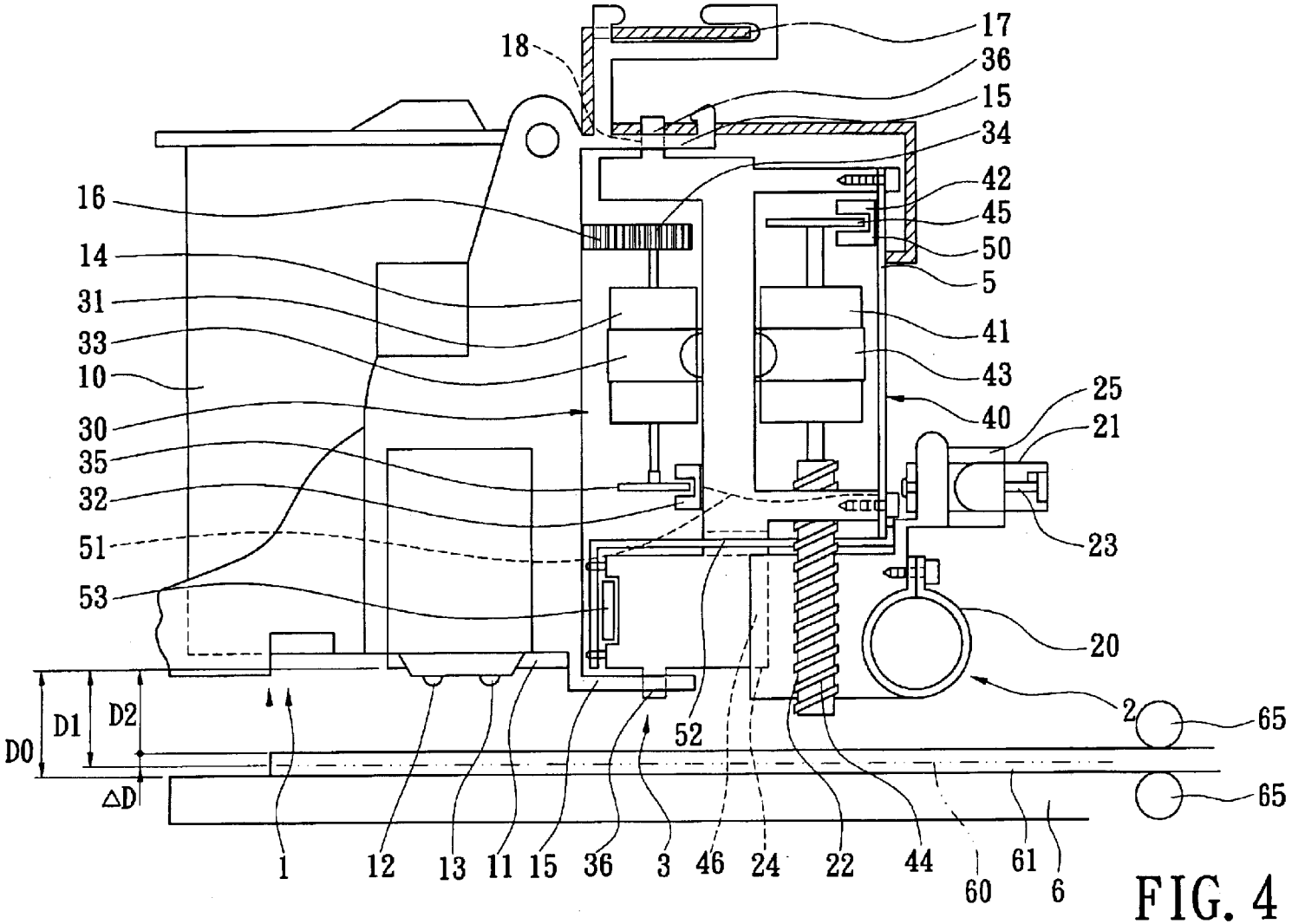
FIG. 4 is a schematic plain view of the lifting unit of the two-dimensional auto compensated multi-axis tolerance adaptive system according to the present invention before its operation.

Referring to FIG. 4, a media feed tray 6 and a media feed roller assembly 65 are provided at one side of the ink jet nozzle 11. The sheet feeding direction of the media feed tray 6 is perpendicular to the sliding direction of the reciprocation mechanism 2. The media feed tray 6 is disposed in parallel to the space detection plane 60 of the clearance sensor 12 and the bias sensor 13. The space detection plane 60 is disposed in parallel to the plane of rotation between the serrated portion 16 of the carrier unit 1 and the pinion 34 of the rotating unit 30. The direction of the normal line of the space detection plane 60 is the direction of the guide screw 44 of the driving mechanism 3 such that the plane of rotation of the rotating unit 30, i.e., the space detection plane 60 forms with the straight lifting line of the guide screw 44 of the lifting unit 40 a X-Y plane and Z-axis space coordinates system, in which the initial distance between the ink jet nozzle 11 of the carrier unit 1 and the media feed tray 6 is D0, and the optimum printing clearance of the space detection plane 60 is D1.

Figure 5:
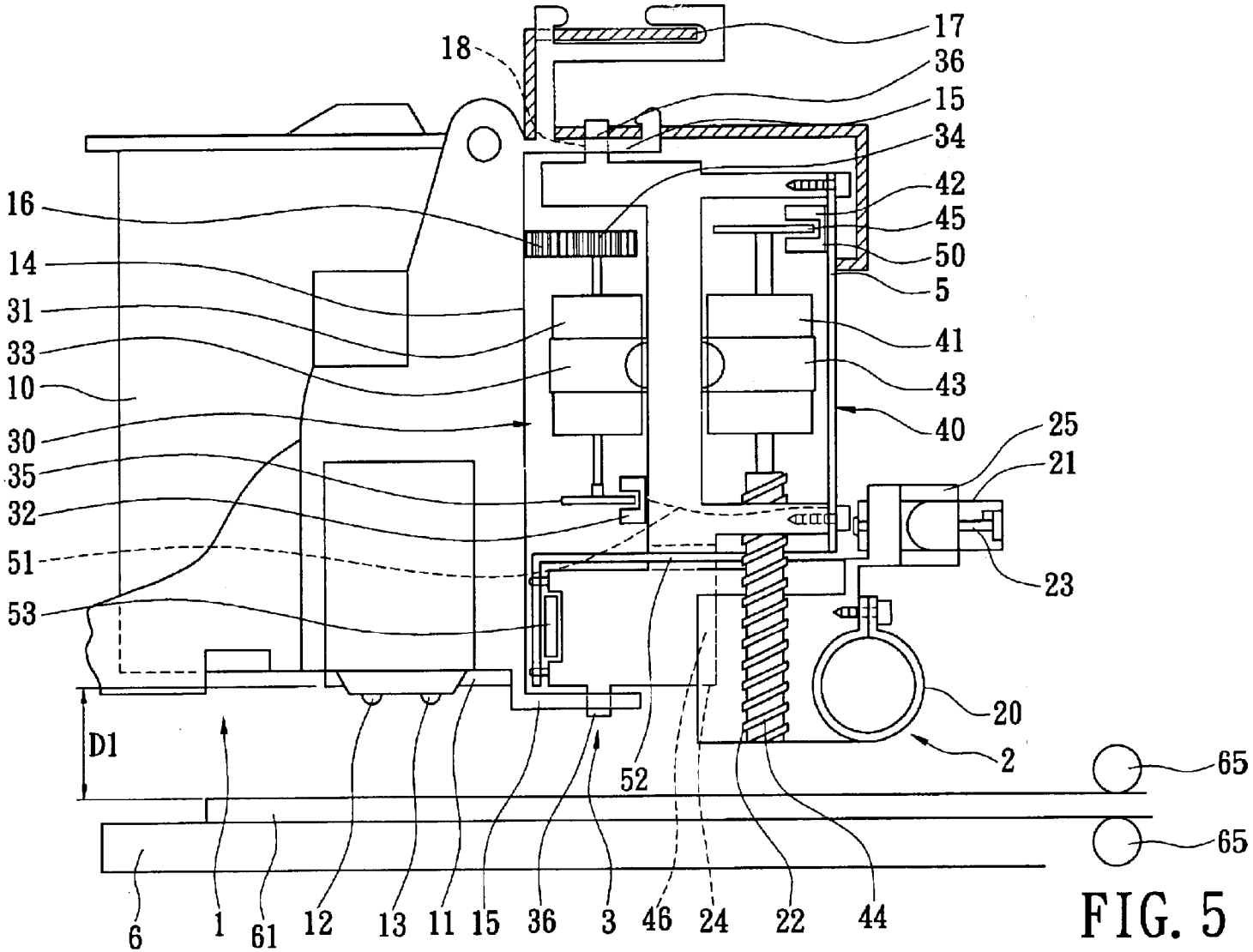
FIG. 5 is a schematic plain view of the lifting unit of the two-dimensional auto compensated multi-axis tolerance adaptive system according to the present invention when obtained the optimum printing clearance.
Figure 8:
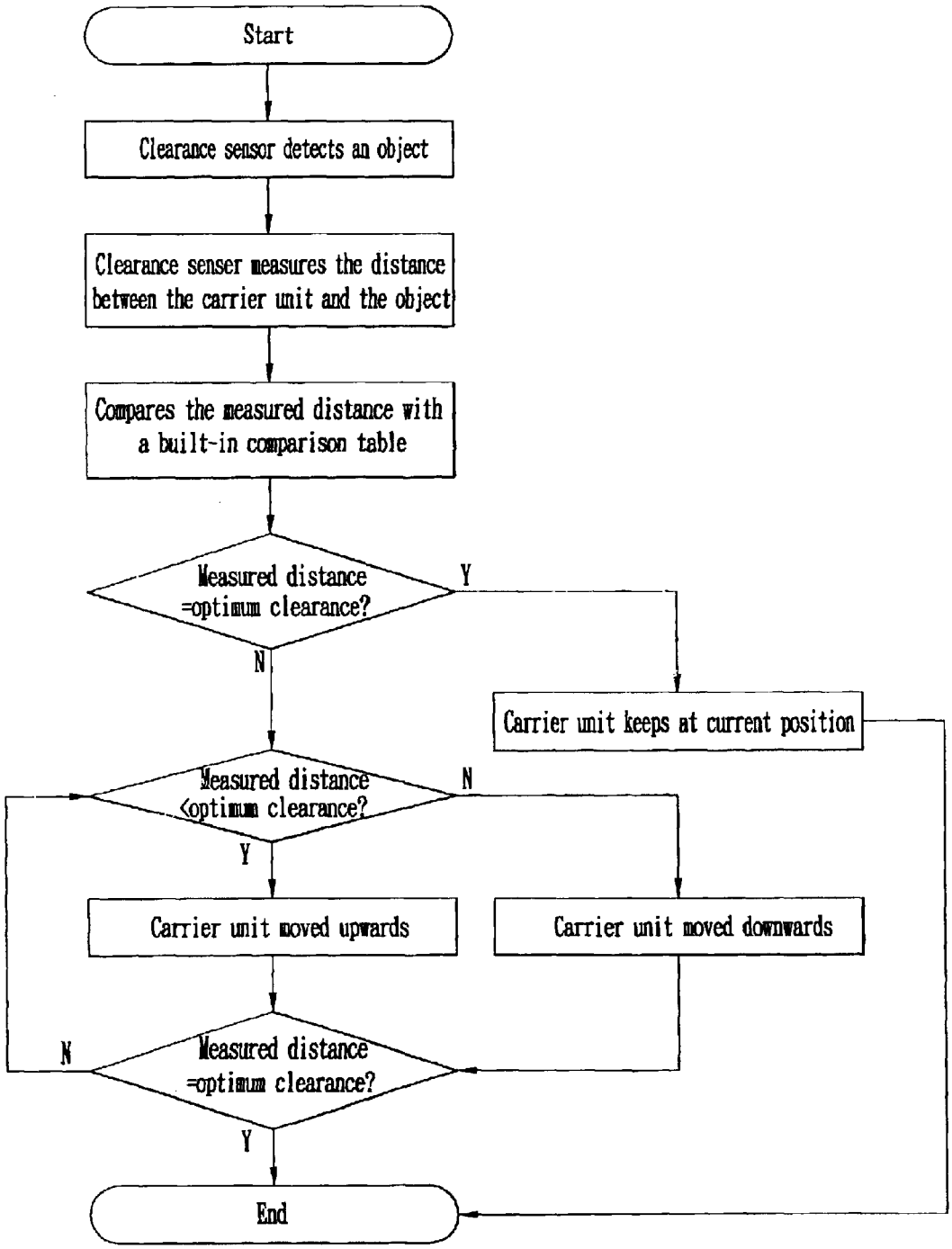
FIG. 8 is a clearance calibration flow chart according to the present invention.

Regarding to the calibration of ink jet clearance, please refer to the flow chart of FIG. 8 and also to FIGS. 4 and 5. When the object, i.e., a sheet of media 61 put in the media feed tray 6, the clearance sensor 12 detects the distance D2 between the ink jet nozzle 11 of the carrier unit 1 and the sheet of media 61, and compares the value of the distance D2 with the comparison table set in the two-dimensional auto compensated multi-axis tolerance adaptive system, so as to obtain the optimum ink jet clearance adjustment value $\Delta D$. The comparison table is built according to the thickness of a variety of media. The data of comparison result thus obtained is fed back for closed loop control through an algorithm. When the distance D2 between the ink jet nozzle 11 of the carrier unit 1 and the sheet of media 61 was shorter or greater than the optimum printing clearance D1, the lifting driver 41 of the lifting unit 40 is started to rotate the guide screw 44 upwards or downwards, thereby causing the dovetail rails 46 of the driving mechanism 3 to be moved along the dovetail grooves 24 of the reciprocation mechanism 2, and therefore the ink jet nozzle 11 of the carrier unit 1 is adjusted along the guide screw 44 in Z-axis direction to reach the optimum printing clearance D1.

Figure 6:
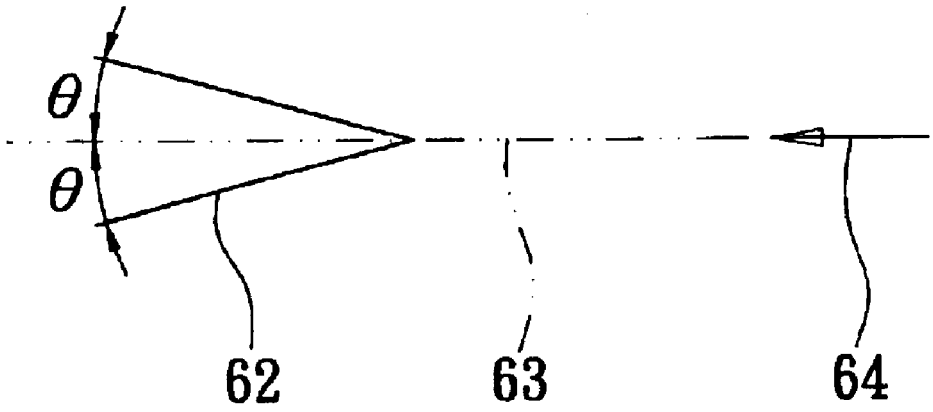
FIG. 6 is a schematic plain view showing the line trace of the initial calibration pattern for the scanning of the bias sensor according to the present invention.
Figure 7:
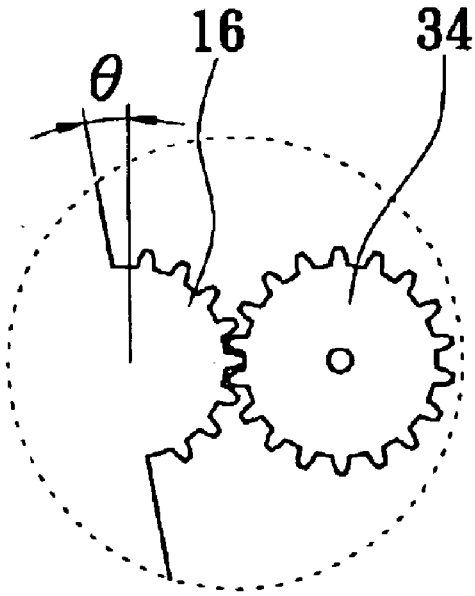
FIG. 7 is a schematic plain view showing the motion of the pinion and the serrated portion and the compensation of the angle of error.
Figure 9:
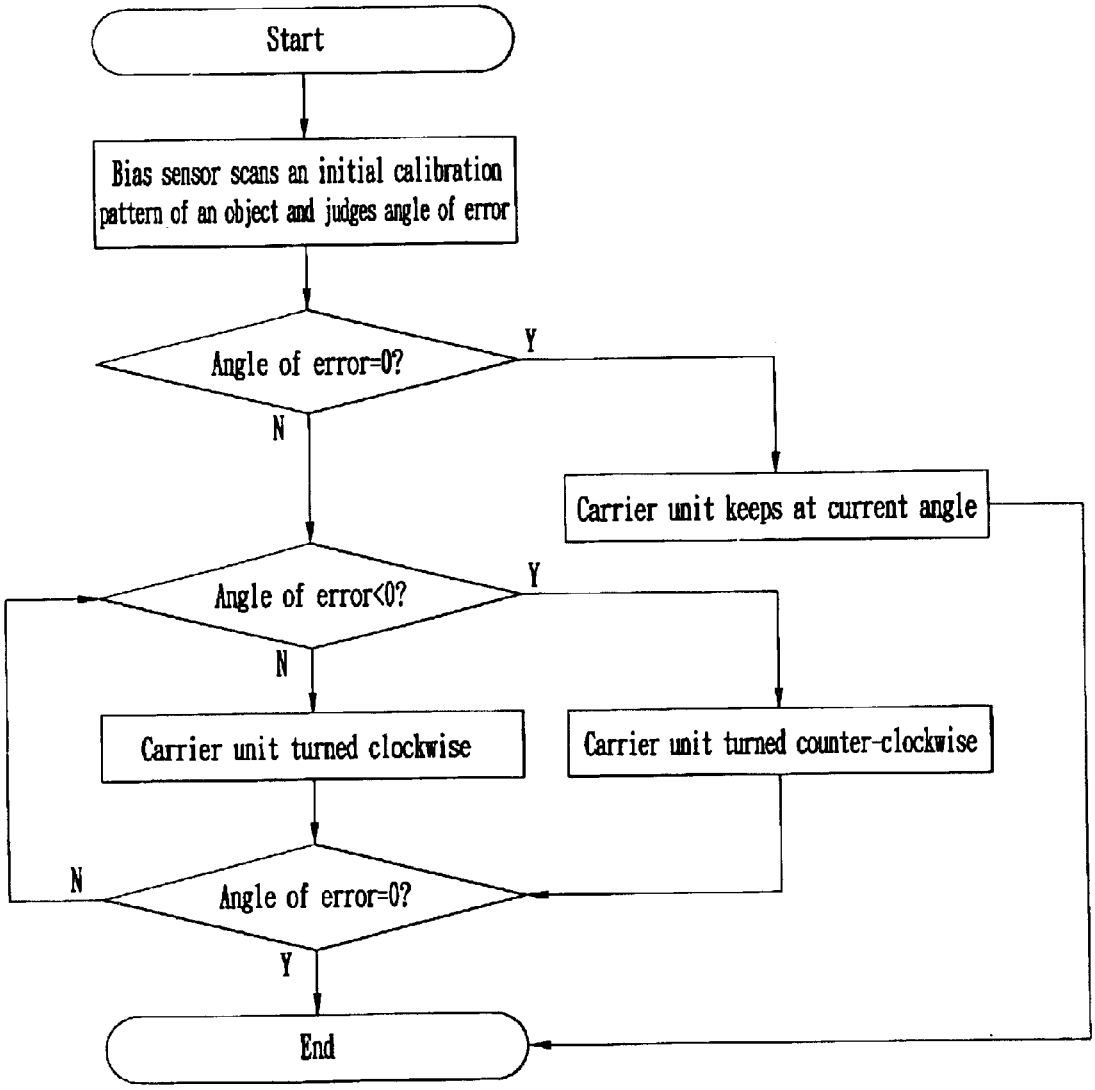
FIG. 9 is a bias calibration flow chart according to the present invention.

Regarding to the calibration of ink jet nozzle printing angle, please refer to the flow chart of FIG. 9 and also to FIG. 6. When the sheet of media 61 moved forwards subject to the media feeding direction 64, the ink jet nozzle 11 makes a forward stroke test line trace printing, enabling the sheet of media 61 to record the result of action and to be printed with an initial calibration pattern 62. When the ink jet nozzle 11 moving back, the bias sensor 13 of the carrier unit 1 scans the initial calibration pattern 62 to determine if there is an angle of error $\theta$ between the line trace and the media feeding direction straight line 63 or not. The angle of error $\theta$ scanned is compared to the pattern default value comparison table built in the two-dimensional auto compensated multi-axis tolerance adaptive system. The data of the comparison result is fed back for closed loop control through an algorithm. If the angle of error $\theta>0$ or $<0$, as shown in FIG. 7, the rotary driver 31 of the rotation unit 30 drives the pinion 34 to turn the serrated portion 16 of the carrier unit 1 clockwise or counter-clockwise, thereby causing the ink jet nozzle 11 to be adjusted on the X-Y plane along Z-axis to the optimum printing angle. Therefore, the straight lines printed by the ink jet nozzle 11 are maintained in parallel to the media feeding direction straight line 63, eliminating the occurrence of line trace biasing.

As indicated above, the two-dimensional auto compensated multi-axis tolerance adaptive system of the present invention has the following advantages:

1. The arrangement of the clearance sensor of the carrier unit and the lifting unit of the driving mechanism enables the ink jet printer to measure the distance between the ink jet nozzle and the media and to make the proper vertical position adjustment, so as to maintain the optimum printing clearance during printing, preventing dragging of ink and improving the printing quality.
2. The arrangement of the bias sensor of the carrier unit and the rotating unit of the driving mechanism enables the ink jet nozzle to adjust the angle of error subject to the initial calibration pattern, so as to compensate and absorb the error of component parts of the ink jet printer, the manufacturing error, and the assembly error, eliminating line trace biasing and discontinuous then improving the printing quality.

While only one embodiment of the present invention has been shown and described, it will be understood that various modifications and changes could be made thereunto without departing from the spirit and scope of the invention.

What the invention claimed is:

1. A two-dimensional auto compensated multi-axis tolerance adaptive system used in a multi-axis motion implement to drive the multi-axis motion implement and to record the driving action in an object, the two-dimensional auto compensated multi-axis tolerance adaptive system comprising:

a carrier unit, said carrier unit comprising a clearance sensor and a bias sensor;

a reciprocation mechanism installed in said multi-axis motion implement to make a reciprocating motion; and a driving mechanism, said driving mechanism comprising a rotating unit fastened pivotally with said carrier unit, and a lifting unit coupled to said reciprocation mechanism for a linear movement for enabling the plane of rotation of said rotating unit to form with the straight lifting line of said lifting unit a X-Y plane and Z-axis space coordinates system;

wherein said carrier unit has a rear sidewall, two lugs protruded from top and bottom sides of said rear sidewall and defining a respective pivot hole for pivoting to said rotating unit, and a serrated portion formed in said rear sidewall and meshed with said rotating unit.

2. The two-dimensional auto compensated multi-axis tolerance adaptive system as claimed in claim 1 wherein said multi-axis motion implement is an ink jet printer, and said carrier unit comprises the ink jet nozzle of said ink jet nozzle.

3. The two-dimensional auto compensated multi-axis tolerance adaptive system as claimed in claim 1 wherein said reciprocation mechanism comprises a guide screw hole coupled to said driving mechanism for enabling said reciprocation mechanism to be reciprocated by said driving mechanism.

4. The two-dimensional auto compensated multi-axis tolerance adaptive system as claimed in claim 3 wherein said reciprocation mechanism comprises a plurality of dovetail grooves arranged in parallel to said guide screw hole and adapted to guide reciprocating motion of said reciprocation mechanism.

5. The two-dimensional auto compensated multi-axis tolerance adaptive system as claimed in claim 4 wherein said lifting unit of said driving mechanism comprises a lifting driver and an encoder, said lifting driver having a guide screw disposed at one end and threaded into the guide screw hole of said reciprocation mechanism and an encoder disposed at an opposite end and peripherally received in the encoder of said lifting unit.

6. The two-dimensional auto compensated multi-axis tolerance adaptive system as claimed in claim 5 wherein said lifting unit comprises a plurality of dovetail rails respectively coupled to the dovetail grooves of said reciprocation mechanism.

7. The two-dimensional auto compensated multi-axis tolerance adaptive system as claimed in claim 5 wherein said driving mechanism comprises a fixed circuit board, said circuit board having a signal line electrically connected to the encoder of said lifting unit to provide clearance control feed back signal, a signal line electrically connected to said multi-axis motion implement for transmitting commands from said multi-axis motion implement to said lifting driver, an a flexible printed circuit board supported on a soft cushion pad for the connection of circuits of said carrier unit for transmitting commands.

8. The two-dimensional auto compensated multi-axis tolerance adaptive system as claimed in claim 1 wherein the rotating unit of said driving mechanism comprises a rotary driver and an encoder, said rotary driver comprising a pinion and an encoder wheel at two distal ends thereof, said pinion being meshed with said serrated portion of said carrier unit, the encoder wheel of said rotary driver being peripherally received in the encoder of said rotating unit.

9. The two-dimensional auto compensated multi-axis tolerance adaptive system as claimed in claim 8 wherein said rotating unit of said driving mechanism comprises two pivot pins axially aligned with said rotary driver and respectively pivoted to the pivot holes of the lugs of said carrier unit.

10. The two-dimensional auto compensated multi-axis tolerance adaptive system as claimed in claim 8 wherein said driving mechanism comprises a fixed circuit board, said circuit board having a signal line electrically connected to the encoder of said rotating unit to provide angle control feed back signal, a signal line electrically connected to said multi-axis motion implement for transmitting commands from said multi-axis motion implement to said rotary driver, an a flexible printed circuit board supported on a soft cushion pad for the connection of circuits of said carrier unit for transmitting commands.

* * * * *